United States Patent [19]

Gierse et al.

[11] Patent Number: 4,646,402

[45] Date of Patent: Mar. 3, 1987

[54] STRETCHING MACHINE

[75] Inventors: Franz-Josef Gierse, Siegen; Heinrich Hermanns, Korschenbroich; Gerhard Lüpnitz, Monchen-Gladbach; Manfred Pabst, Cologne; Heribert Schlicht, Monchen-Gladbach, all of Fed. Rep. of Germany

[73] Assignee: A. Monforts GmbH & Co., Monchen-Gladbach, Fed. Rep. of Germany

[21] Appl. No.: 732,441

[22] Filed: May 9, 1985

[30] Foreign Application Priority Data

May 9, 1984 [DE] Fed. Rep. of Germany ..... 3417030

[51] Int. Cl.[4] ..... D06C 3/02

[52] U.S. Cl. ..... 26/86; 26/89; 26/96

[58] Field of Search ..... 26/74, 76, 86, 89, 96

[56] References Cited

FOREIGN PATENT DOCUMENTS 1060344 7/1959 Fed. Rep. of Germany ..... 26/86

46-26433 7/1971 Japan ..... 26/76

*Primary Examiner*—Robert R. Mackey

*Attorney, Agent, or Firm*—Herbert L. Lerner; Laurence A. Greenberg

[57] ABSTRACT

A stretching machine for webs of textile material includes a feeding region of the machine for receiving a web of material in a given travel direction, a driven drawing-in cylinder for engaging the web of material, mutually and adjustably spaced apart chain tracks being pivotable about vertical axes in the feeding region, endless needle chains each being deflected in a respective one of the chain tracks for running into and out of the web of material, a needle engagement device downstream of the drawing-in cylinder in the given travel direction of the web of material for running the web of material onto the needle chains, a support for the drawing-in cylinder being movable in the given travel direction of the web of material, and a device connected to the support for maintaining a constant distance between the drawing-in cylinder and the needle engagement device.

6 Claims, 4 Drawing Figures

STRETCHING MACHINE

BACKGROUND OF THE INVENTION

1. Field of the Invention

The invention relates to a stretching machine for webs of textile material with a driven drawing-in cylinder and chain tracks which are pivoted in the feeding region of the machine about vertical axes, the chain tracks being mutually and adjustably spaced apart for accomodating endless needle chains reversed or deflected for running into and out of the web of material, and a needle-engagement device at each chain track downstream of the drawing-in cylinder, as seen in the direction of the travel of the web.

2. Description of the Related Art

The entrance or feeding region of such a machine, which is also referred to as a tenter frame in the art, is described in German Published, Non-Prosecuted Application No. DE-OS 22 08 756. The drawing-in cylinder is customarily supported at the entrance of the machine frame. The operator of the machine normally stands on the side of the drawing-in cylinder facing away from the entrance area in such a way that he or she can survey the drawing-in area and particularly the needle engagement operation. If the needle engagement of the web of material is initially made improperly, it is sometimes even necessary to render assistance manually. For this reason, it is desirable to maintain the distance from the needle engagement point to the position of the operator and therefore the distance between the chain reversal wheel (of the entrance area) and the drawing-in cylinder, as small as possible. In the machine known from German Patent DE-PS No. 22 08 756, the entrance cylinder is brought so close to the needle engagement rolls of the needle engagement device that it can serve directly as the feeding element and even as the drive element for the needle engagement rolls. It is a disadvantage of the prior art machine that the lengthening of the chain and the chain track caused by wear of the pins and thermal expansion, which can increase up to the length of a chain link (since one chain link is removed if the lengthening is greater) cannot normally be compensated in the entrance or feeding area. This is because the maneuvering space required therefor is not available, since the distance between the drawing-in cylinder and the needle engagement point is set at a minimum.

In the journal "Textilveredlung" 13 (1978) page 319, a report is given regarding a stretching machine with a vertically deflected chain, the chain stretching means of which are disposed in the delivery or end area, so that the distance between the drawing-in cylinder and the needle engagement point is to remain constant. In this connection, the fact that the chain track itself has thermal expansion which, depending on the entire installation, is in general between 50 and 100 mm, is not taken into consideration. The distance between the drawing-in cylinder and the needle engagement point therefore varies by at least this amount even if some length change of the chain itself is compensated in the exit area of the machine. This difficulty could be counteracted if the fixed point of the chain track were placed as close as possible to the entrance area and in particular to the area of the vertical pivot axes of the chain track which delineate the entrance from the remaining part of the web. However, other disadvantages would again become more significant.

On one hand, the entire length change of the chain and the train track would be shifted into the exit region, so that the chain drive normally provided at this point would have to be movably supported. On the other hand, the chain tracks and the treatment chamber of the stretching machine would have fixed thermal-expansion points that would be different from each other, so that the fastening of the chain track within the chamber would become accordingly difficult.

SUMMARY OF THE INVENTION

It is accordingly an object of the invention to provide a stretching machine which overcomes the hereinaforementioned disadvantages of the heretofore-known devices of this general type, to set the distance between the drawing-in cylinder and the chain reversal wheel in the entrance area or between the drawing-in cylinder and the needle engagement device, to minimum values, and to simultaneously retain the fixed point of the chains and the chain track in the exit section of the machine, in such a manner that the needle engagement point can be reached equally well by hand from the position of the operator at the entrance of the web of material for any chain track and chamber expansion as well as for chain wear conditions.

With the foregoing and other objects in view there is provided, in accordance with the invention, a stretching machine for webs of textile material, comprising a feeding region of the machine for receiving a web of material in a given travel direction, a driven drawing-in cylinder for engaging the web of material, mutually and adjustably spaced apart chain tracks being pivotable about vertical axes in the feeding region, endless needle chains each being deflected or reversed in a respective one of said chain tracks for running into and out of the web of material, a needle engagement device downstream of the drawing-in cylinder in the given travel direction of the web of material for running the web of material onto the needle chains, a support for the drawing-in cylinder being movable in the given travel direction of the web of material, and means connected to the support for maintaining a constant distance between the drawing-in cylinder and the needle engagement device. This means that the drawing-in cylinder is controlled with respect to keeping a constant distance from the needle engagement device to the chain track.

In accordance with another feature of the invention, there is provided a machine frame having a feeding portion, the feeding portion being part of the support for the drawing-in cylinder. In accordance with a further feature of the invention, the support includes an operator's platform.

Depending on the construction, it may also be advantageous to movably support parts of the feeding section together with the drawing-in cylinder. If even the platform is supported so that it moves together with the drawing-in cylinder, the distance between the operator and the needle engagement point can be controlled to fixed values. Accordingly, the invention ensures that at least the drawing-in cylinder located between the operator and the needle engagement point occupies the most favorable position for an engagement into the needle engagement point and at the same time for chain or chain track extensions. Since the entire length changes of the chain and the chain track are therefore taken up by the support of the drawing-in cylinder (although it is movable relative to the foundation of the machine), its fixed distance from the needle engagement points, and the distance between the needle disengagement point or the deflection rollers of the chain and the drawing-in cylinder are predetermined and fixed, so that no problems arise with the support of the deflection wheels in the exit area of the machine, which generally can be coupled to the chain drive. For instance, the deflection wheels in the machine exit can be driven mechanically by a spline shaft with a differential.

The invention relates to stretching machines with stretching chains horizontally deflected in the entrance and exit area as well as to machines with vertically deflected stretching chains. Although in the present context, mostly needle chains, needle engagement points, needle engagement wheels and the like are mentioned for the sake of simplicity, the features of the invention also equally apply to stretching machines which hold the web of material in jaws or similar clamping means. In this case, the terms "needle engagement", "needle engagement points", etc. stand for the corresponding terms such as "holding by jaws", "jaw holding point", etc. in the case of machines equipped with jaws or the like.

In accordance with an added feature of the invention, the drawing-in cylinder has journals disposed directly in the support.

In accordance with a concomitant feature of the invention, the chain tracks have head sections disposed closest to the drawing-in cylinder on the entrance side of the chain tracks, and the distance maintaining means are operatively connected or coupled to at least one of the head sections, such as electrically, mechanically, optically or hydraulically.

Other features which are considered as characteristic for the invention are set forth in the appended claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
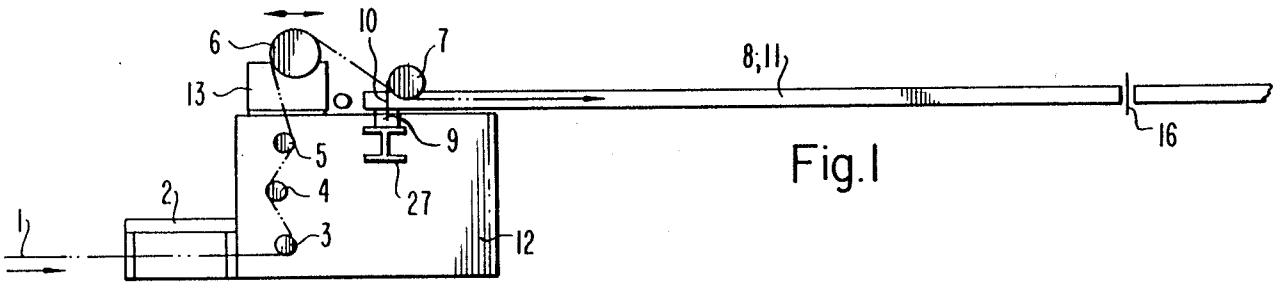
FIG. 1 is a diagrammatic, cross-sectional view of the entrance or feeding section of a stretching machine perpendicular to the longitudinal axis of the drawing-in cylinder.

Referring now to the figures of the drawings in detail and first, particularly, to FIG. 1 thereof, there is seen a stretching machine in which material 1, such as foulard material which is not shown in detail, runs in the direction of the arrow under an operator's platform 2, past a feed roll 3, a transverse-stretching roll 4 and a deflection roll 5 to an engagement or drawing-in roll 6. From the engagement roll 6, the material runs onto a needle chain 8 at each edge of the material, with the assistance of a needle engagement wheel 7 of an engagement device defining an engagement point at each edge. In the illustrated embodiment, each needle chain 8 is horizontally deflected about a sprocket wheel 9 with a vertical axis 10. The deflection or sprocket wheel 9 is supported in a chain track 11 associated with the needle chain 8 and is braced against a machine frame 12, such as in a cross piece 27 disposed substantially transversely to the travel direction of the web. The feed roll, transverse stretching roll, deflection roll and engagement or drawing-in roll (3 to 6) are also supported in the machine frame 12. The bearing of each needle engagement wheel 7 is, of course, firmly coupled to the associated chain track 11 and therefore participates in any motion of the chain track.

Figure 2:
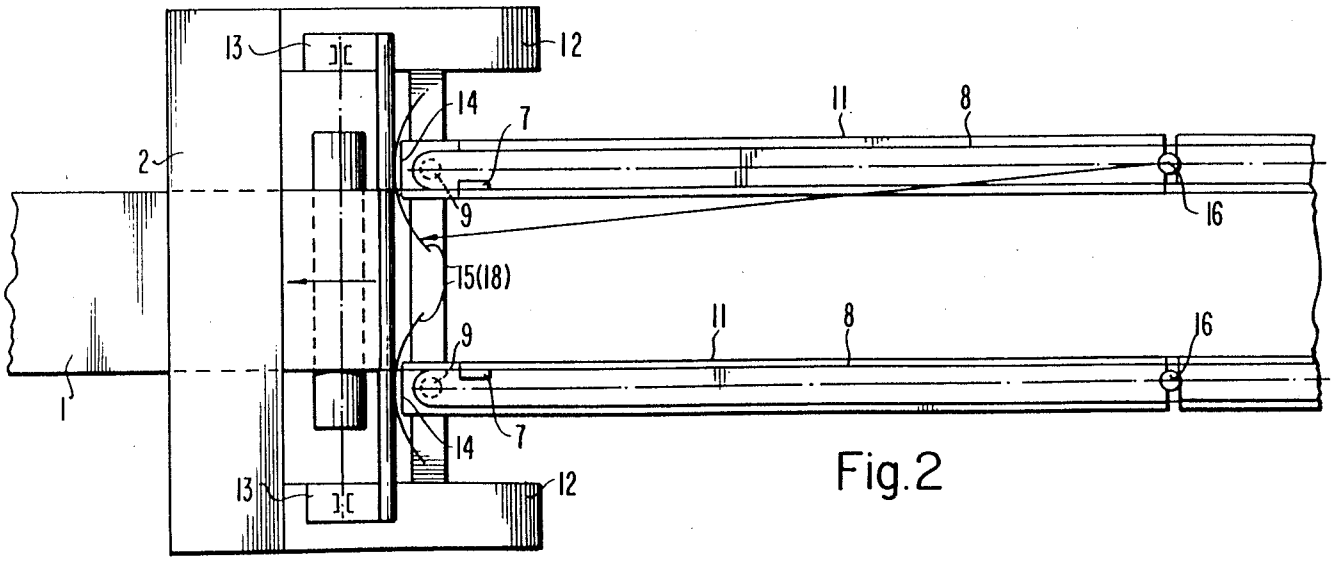
FIG. 2 is a fragmentary, top-plan view of the entrance section of a stretching machine according to FIG. 1.

While, in accordance with the invention, bearings 13 of the drawing-in cylinder 6 are disposed on the machine frame 12, they are movably supported relative to the frame 12 in such a way that they can follow length changes of the chain 8 and the associated chain track 11 which may occur, similar to a rigid coupling, as shown in FIG. 2 which is a top view of the entrance or feeding area of a stretching machine. In the illustrated embodiment, the bearings 13 of the drawing-in cylinder 6 are mechanically coupled to the chain tracks 11 in vicinity of the respective deflection wheels 9. This coupling controls the thermal expansion of the chain tracks 11 and the lengthening of the needle chain 8, as a function of the respective position of the chain deflection wheel 9.

As shown in FIG. 2, end points 14 of the chain tracks 11 describe circular arcs 15 at the deflection wheels 9 if the chain tracks 11 are swung more or less toward or away from each other about pivots 16 along vertical axes thereof, depending on the requirements in the entrance area of the machine.

Figure 3:
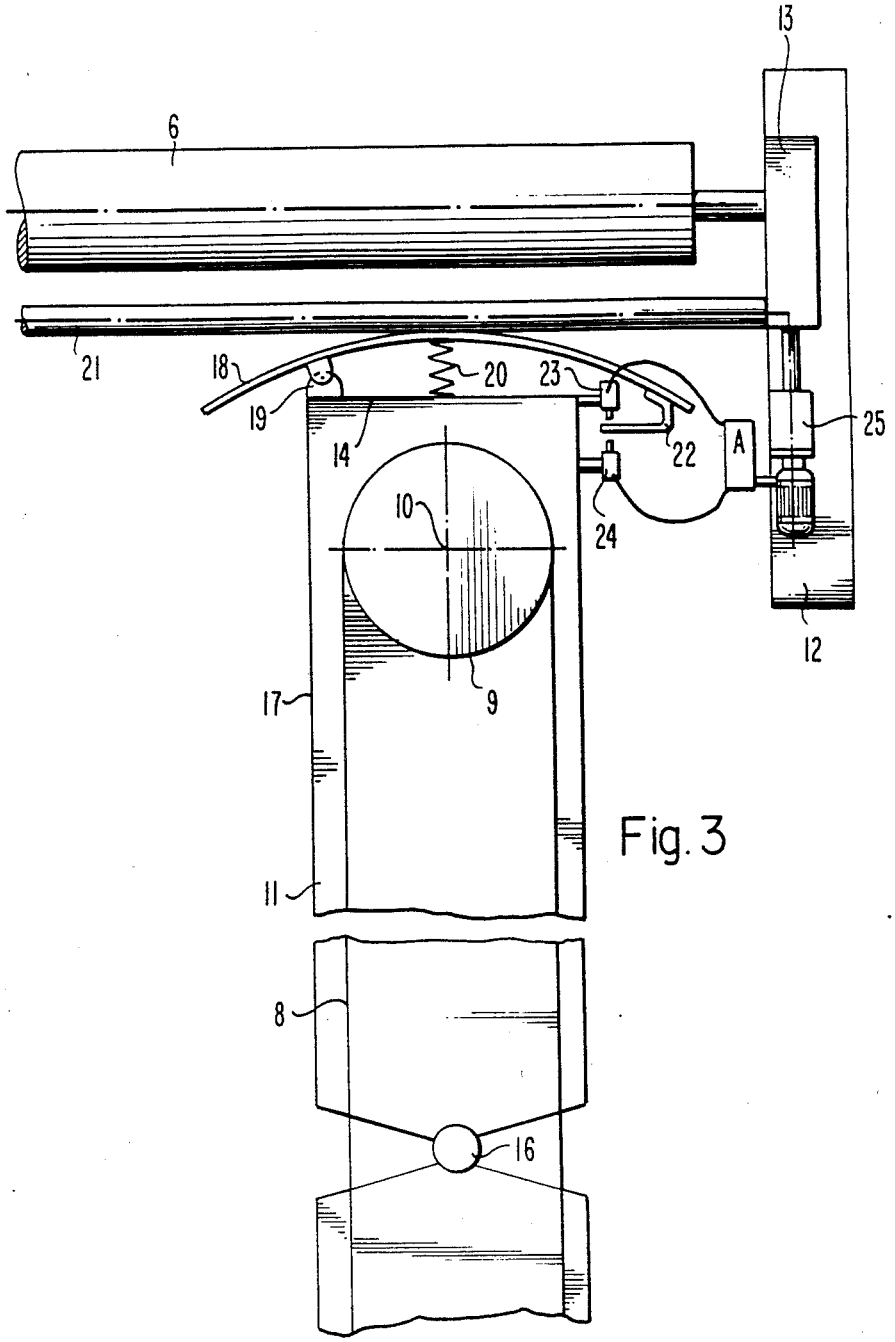
FIG. 3 is an enlarged, fragmentary, top-plan view of an apparatus for maintaining a constant distance between the drawing-in cylinder and the needle engagement point of a stretching machine.

An embodiment of control and regulating means for adjusting a constant distance between the drawing-in cylinder 6 and the needle engagement wheel 7 of the stretching machine, is explained below with reference to FIG. 3.

If the chain tracks 11 are swung about their pivots 16, the end points 14 of the chain tracks 11 at the deflection wheel 9 are brought closer to or further away from the drawing-in cylinder 6 along the circular arcs 15. It is advantageous to determine the present distance between the end point 14 of the chain track and the drawing-in cylinder 6 and to create a control which is suitable for practical requirements, with control commands that are not too frequent. In order to accomplish this, the head 17 of the chain track 11 facing the drawing-in cylinder 6 may be equipped with a sensor baffle 18 which is bent in accordance with the circular arc 15 and is disposed beyond the end point 14. The baffle 18 is held in a position wherein it is pivoted in a hinge 19 and is pushed by means of a spring 20 in the direction toward the drawing-in cylinder 6 against a guide arm 21. This sensor baffle 18 has an attached tab 22 at the end thereof opposite the hinge 19, which can touch a contact 23 or 24 of an end switch, depending on whether or not the distance between the needle engagement point and the guide arm 21 or the drawing-in cylinder 6 has the required value. As indicated by the broken line arrow, the control command originating at one of the end switch contacts 23, 24 can optionally be passed on through amplifiers A to a drive 25 with which the bearings 13 of the drawing-in cylinder 6 are associated and which controls the bearings synchronously. Since the two chains tracks 11 and the chains 8 of the stretching machine can be expanded or contracted by slightly different amounts, it may be advisable to equip both chain tracks with the sensor tab 22 of a sensing device and to transmit the corresponding control commands jointly to the drive 25.

Preferably, only one chain track 11 is equipped with a sensing device which serves for controlling the distance between the drawing-in cylinder and the needle engagement point; for compensating slight differences in the length change, it may be advisable to choose a slightly larger safety margin between the drawing-in cylinder and the chain tracks than in the case in which a sensing device is used at each end point of both chain tracks. Opto-electrical, purely electrical, hydraulic, pneumatic or purely mechanical devices as well as combinations thereof are suitable for control, besides the above-described electro-mechanical device.

Figure 4:
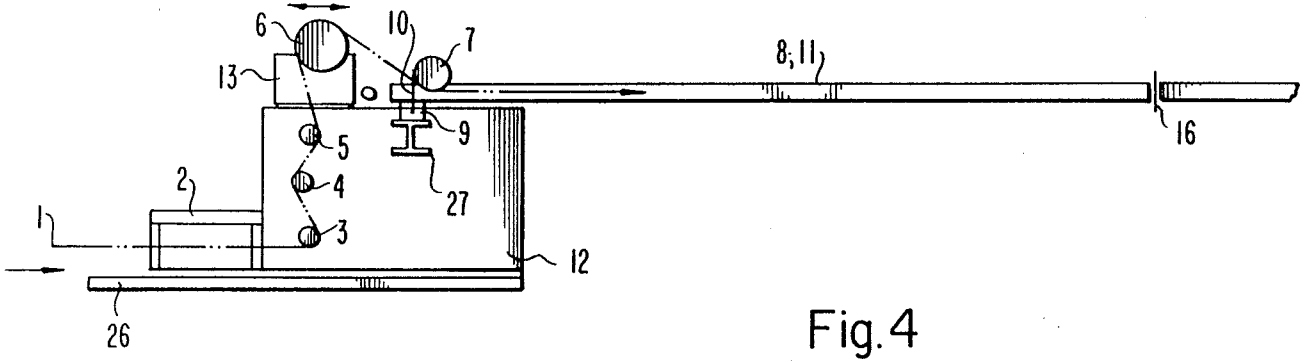
FIG. 4 is a view similar to FIG. 1 showing another embodiment of the movable support.

The above-described embodiment relates to the case of a drawing-in cylinder 6 which is contained directly in the movable, controlled bearing system. However, the invention relates to all cases in which larger or smaller regions of the entrance part of the machine frame 12, including the drawing-in cylinder 6, are movably supported so that the distance between the needle engagement device and the drawing-in cylinder can be regulated in order to remain constant. Thus, the movable support can be formed by a track guide 26 shown in FIG. 4. The track guide 26 together with the machine frame 12 can also contain the operating platform 2. If the machine frame 12 is movable, its cross piece 27 supporting the chain guide 18 must be made so large or wide that it can fulfill its purpose reliably, for any position of the machine frame.

Although the invention is illustrated and described herein as embodied in a stretching machine, it is nevertheless not intended to be limited to the details shown, since various modifications and structural changes may be made therein without departing from the spirit of the invention and within the scope and range of equivalents of the claims.

We claim:

1. Stretching machine for webs of textile material, comprising a feeding region of the machine for receiving a web of material in a given travel direction, a driven drawing-in cylinder for engaging the web of material, mutually and adjustably spaced apart chain tracks being pivotable about vertical axes in said feeding region, endless needle chains each being deflected in a respective one of said chain tracks for running into and out of the web of material, a needle engagement device disposed on said chain tracks downstream of said drawing-in cylinder in said given travel direction of the web of material for running the web of material onto said needle chains, a support for said drawing-in cylinder being movable in said given travel direction of the web of material, and means connected to said support and to said chain tracks for sensing a variation in distance between said drawing-in cylinder and said chain tracks and for moving said support for maintaining a constant distance between said drawing-in cylinder and said needle engagement device.

2. Stretching machine according to claim 1, including a machine frame having a feeding portion, said feeding portion being part of said support.

3. Stetching machine according to claim 2, wherein said support includes an operator's platform.

4. Stretching machine according to claim 1, wherein said drawing-in cylinder has journals disposed directly in said support.

5. Stretching machine according to claim 1, wherein said chain tracks have head sections disposed adjacent said drawing-in cylinder, and said distance maintaining means include sensor means operatively connected to at least one of said head sections responsive to a change in distance between said drawing-in cylinder and said needle engagement device upon pivotal movement of said chain tracks for actuation of said distance maintaining means to maintain said constant distance.

6. Stretching machine according to claim 1, wherein said chain tracks have head sections disposed adjacent said drawing-in cylinder, and said distance maintaining means include control means coupled to at least one of said head sections responsive to a change in distance between said drawing-in cylinder and said needle engagement device upon pivotal movement of said chain tracks for actuation of said distance maintaining means to maintain said constant distance.

* * * * *